US005451048A

United States Patent [19]

Magamoto et al.

[11] Patent Number: 5,451,048

[45] Date of Patent: Sep. 19, 1995

[54] GOLF CLUB HEAD

[75] Inventors: Itsushi Magamoto; Tatsuya Hirakawa, both of Shizuoka, Japan

[73] Assignee: Yamaha Corporation, Japan

[21] Appl. No.: 156,588

[22] Filed: Nov. 23, 1993

[30] Foreign Application Priority Data

Nov. 24, 1992 [JP] Japan ..... 4-334948

[51] Int. Cl.[6] ..... A63B 53/02

[52] U.S. Cl. ..... 273/80.2; 273/167 E

[58] Field of Search ..... 273/167 E, 167 G, 80 C, 273/80.1, 80.2, 67 A, 167 R, 167 F, 169, 80 B; D21/217, 218, 219, 220

[56] References Cited

U.S. PATENT DOCUMENTS

| | | | |
|---|---|---|---|
| D. 302,715 | 8/1989 | Petersen | 273/167 D |
| 1,528,017 | 3/1925 | Gammeter | 273/167 E |
| 1,787,415 | 12/1930 | Washington | 273/167 E |
| 1,952,624 | 3/1934 | Inman | 273/167 R |
| 2,088,095 | 7/1937 | Sargent | 273/167 E |
| 3,595,577 | 7/1971 | Hodge | 273/167 E |
| 4,013,288 | 3/1977 | Goverde | 273/67 A |
| 4,065,133 | 12/1977 | Gordos | 273/167 E |
| 4,795,153 | 1/1989 | Thomas | 273/81.3 |
| 4,832,344 | 5/1989 | Werner | 273/174 |
| 4,892,316 | 1/1990 | Langert et al. | 273/167 E |
| 4,951,949 | 8/1990 | Kastenhuber | 273/167 G |

FOREIGN PATENT DOCUMENTS

| | | | |
|---|---|---|---|
| 1-94875 | 4/1989 | Japan . | |
| 322635 | 12/1929 | United Kingdom | 273/169 |

*Primary Examiner*—Sebastiano Passaniti
*Attorney, Agent, or Firm*—Ostrolenk, Faber, Gerb & Soffen

[57] ABSTRACT

In construction of a golf club head made of metal or fiber reinforced plastics, its hosel is configured such that rigidity in the toe-to-heel direction is larger than that in the ball-shooting direction. During swinging of the club to impact a ball, not only does the shaft of the club flex but also its hosel. This double flexing results in increased impact on the ball. In addition, the specified rigidity distribution avoids undesirable toe-down deformation which tends to cause mishitting of the ball.

4 Claims, 8 Drawing Sheets

GOLF CLUB HEAD

BACKGROUND OF THE INVENTION

The present invention relates to a golf club head, and more particularly relates to improvement in dynamic behaviour at shooting balls of the hosel of a golf club head made of metal or FRP (fiber reinforced plastics).

Conventionally, the major role expected for the hosel of a golf club head is to smoothly join the head main body to the shaft.

In the case of a wood-type club head made of persimmon, for example, its hosel is designed to smoothly converge towards the shaft for visual amenity and reduction in stress concentration. In the case wood-type club head having a metallic shell construction, its hosel is designed in the form of a straight pipe which is generally called "a pencil neck". Host conventional wood-type club heads are classified into one of the above-described two types.

In the case off a wood-type carbon club head with an FRP shell, the hosel is designed selectively in one of the two types depending on user's demand.

In use off such an wood-type club head, its shaft flexes during swing to generate repulsion which accelerates movement of the club head to pose intensive impact on a ball at the very moment of shooting.

In configuration of the main body of a club head, its face has a nominal loft angle ($\alpha$) chosen in accordance with the grade of the club head. However, its actual, i.e. effective loft angle ($\beta_1$) is dependent upon the repulsion generated by flexing of the shaft. Generally, the effective loft angle is larger than the nominal loft angle ($\alpha(\beta_1)$. This effective loft angle ($\beta_1$) wields a great influence on the flying course and distance of a ball shot by the club head.

As stated above, the major expected role of the hosel of a conventional club head is to smoothly join the main body to the head only and the hosel has no virtual resiliency in the ball-shooting direction. As a consequence, the effective loft angle ($\beta_1$) at impact is dependent upon repulsion generated by flexing of the shaft only. Stated otherwise, intensity of impact is swayed by dynamic behaviour of the shaft during swing motion only.

For these reasons, when a ball is shot by a conventional golf club head, the ball is small in launch angle and large in backspin. Here, the term "launch angle" refers to the angle between the upward flying course of the ball at the very moment of impact and the horizontal direction. Whereas the term "backspin" refers to reverse rotation of the ball causing it to bounce or roll backward or stop short. As a result of small launch angle and large backspin, the ball after impact traces a low altitude course. The ball cannot fly a long distance and, after fall on the ground, cannot roll much. Thus, the ball is very poor in flying distance when shot by a conventional golf club head.

One type example of the conventional wood-type golf club head is disclosed in Japanese Patent Opening Hei. 1-94875 in which the thickness ($t_1$) of the hosel in the ball-shooting direction (X) is larger than the thickness ($t_2$) in the toe-to-heel direction (Y). The small thickness ($t_2$) in the toe-to-heel direction reduces air resistance acting on the club head during swing motion. Such reduced air resistance during swing motion well avoids undesirable lowering in speed of the club head at the very moment of impact on a ball and assures appreciable increase in flying distance of the ball.

In the case of a club head with the main body made of metal or carbon, the above-described design of the hosel ($t_1$) $t_2$) results in smaller flexual rigidity in the toe-to-heel direction (Y) than in the ball-shooting direction (X) and, as a consequence, the hosel flexes in a normal direction (Z) with respect to the ground G.

When the hosel flexes in such a normal direction (Z), the club head undergoes so-called "toe-down deformation" at the very moment of impact on a ball. More specifically, the hosel deforms towards the ground G such that the center of gravity H of the main body falls on an extension of the axis of the shaft connected to the main body via the hosel. Due to such toe-down deformation, the ball is shot at a position of the face off the sweet spot, thereby often causing player's misstep in shot.

SUMMARY OF THE INVENTION

It is the primary object of the present invention to improve dynamic behaviour of the hosel of a golf club head in order to provide intensive impact on a ball and assure increased flying distance of the ball.

It is another object of the present invention to improve design of the hosel of a golf club head in order to avoid undesirable tow-down deformation at impact on a ball and assure correct meeting of the face with the ball at the impact.

In accordance with the basic aspect of the present invention, when the main body of a golf club head is made of metal or FRP, rigidity of the hosel is designed larger in tow-heel direction than in ball-shooting direction.

In accordance with one preferred embodiment of the present invention, the hosel is larger in thickness in the tow-heel direction than in the ball-shooting direction.

DESCRIPTION OF THE PREFERRED EMBODIMENTS

Figure 1:
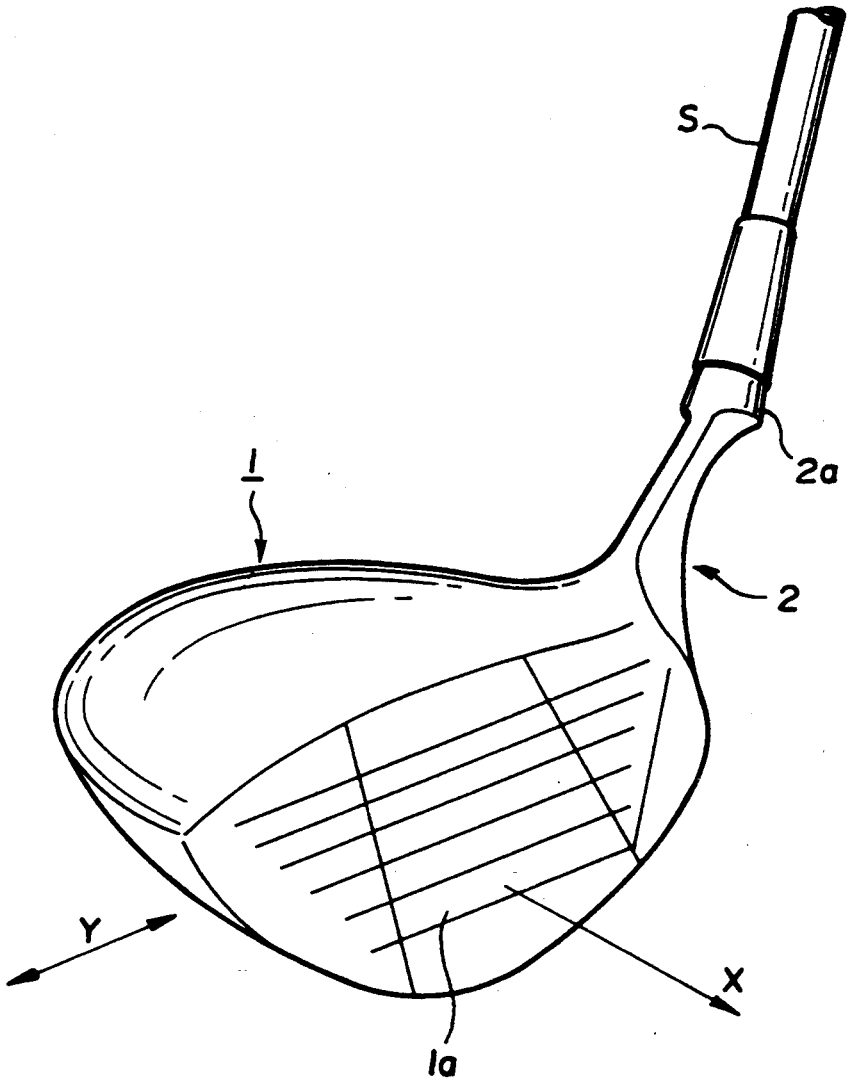
FIG. 1 is a perspective view of one embodiment of the golf club head in accordance with the present invention.
Figure 2:
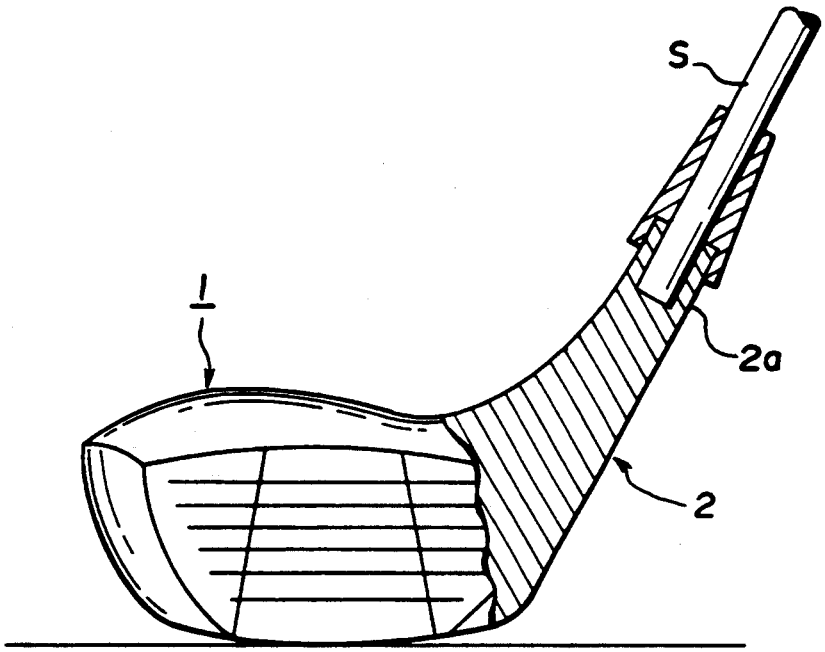
FIG. 2 is its front view partly in section.
Figure 3:
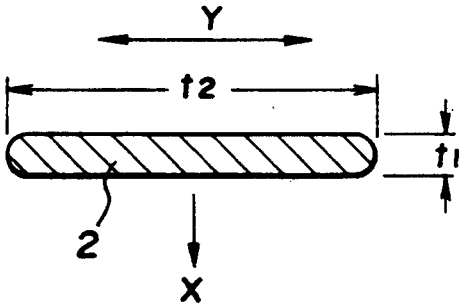
FIG. 3 is a transverse cross sectional view of its hosel.

One embodiment of the golf club head in accordance with the present invention is shown in FIG. 1 to 3, in which a main body 1 of the club head has a hollow construction with a shell made of metal or FRP and a shaft S is coupled at a joint 2*a* via a tapering hosel 2.

As shown in FIG. 3, the hosel 2 has a special configuration in which its thickness ($t_1$) in ball-shooting direction (X) is smaller than its thickness ($t_2$) in toe-to-heel direction (Y). Stated otherwise, the hosel 2 is larger in flexual rigidity in the toe-to-heel direction (Y) than in the ball-shooting direction (X).

Figure 4:
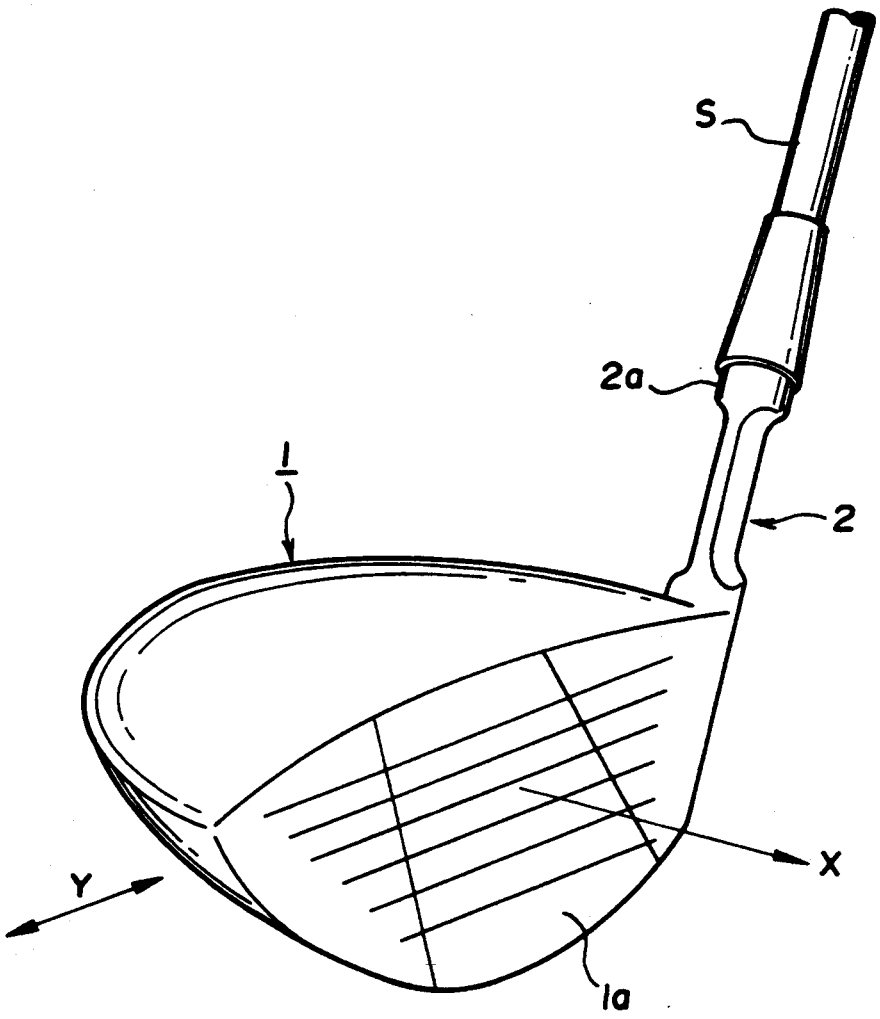
FIG. 4 is a perspective view of another embodiment of the golf club head in accordance with the present invention.

Another embodiment of the golf club head in accordance with the present invention is shown in FIG. 4, in which the club head had a straight, cylindrical hosel 2. In this case also, the hosel 2 is larger in thickness in the toe-to-heel direction (Y) than in the ball-shooting direction (X).

Figure 5:
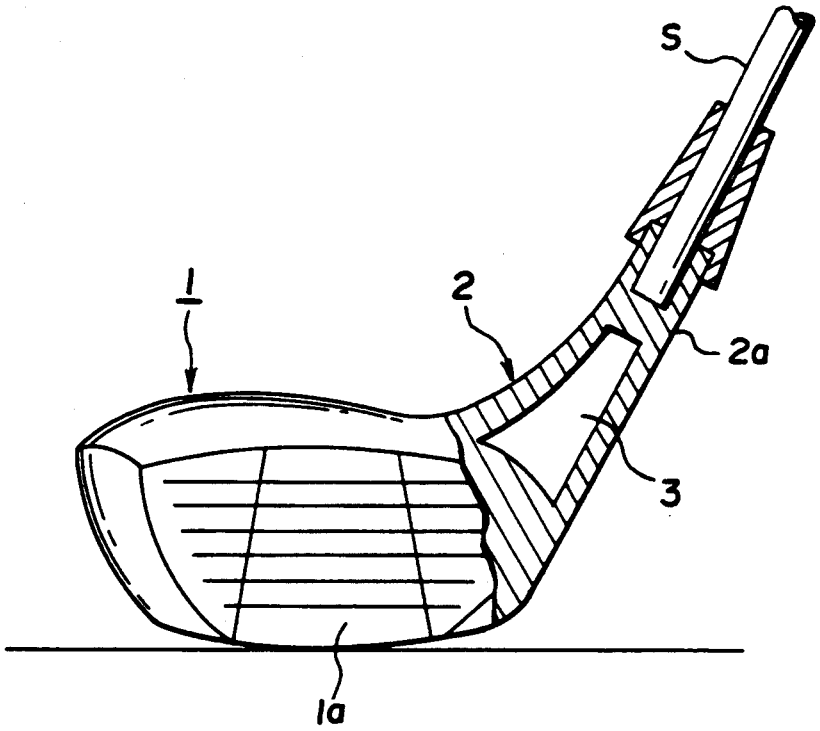
FIG. 5 is a front view of the other embodiment of the golf club head in accordance with the present invention.
Figure 6:
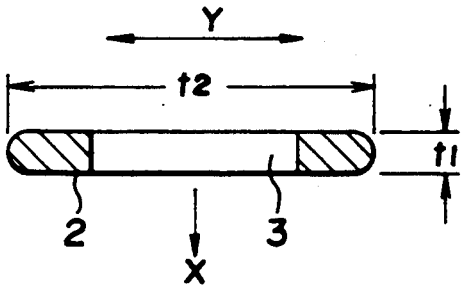
FIG. 6 is a transverse cross sectional view of its hosel.

The other embodiment of the golf club head in accordance with the present invention is shown in FIGS. 5 and 6, in which a tapering hosel 2 is provided with a through window 3 extending in the ball-shooting direction (X). As in the preceding embodiment, the hosel 2 is larger in thickness in the toe-to-heel direction (Y) than in the ball-shooting direction. Presence of such a through window 3 well promotes flexibility of the hosel 2 in the ball-shooting direction (X) and much reduces air resistance acting on the club head during swing motion.

Figure 7:
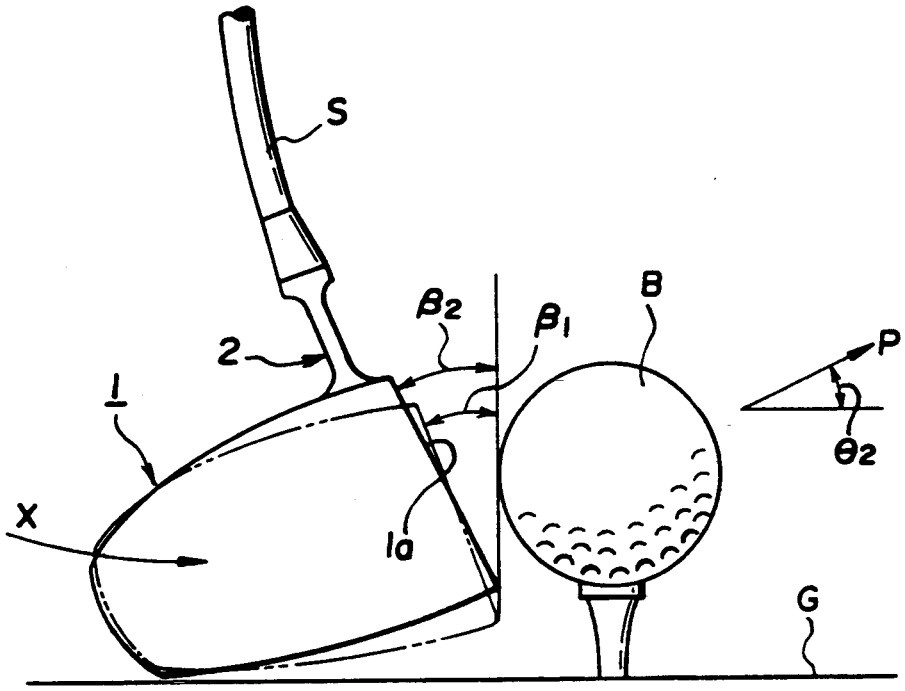
FIG. 7 is a side view of a golf club head in accordance with the present invention at shooting a ball.
Figure 9:
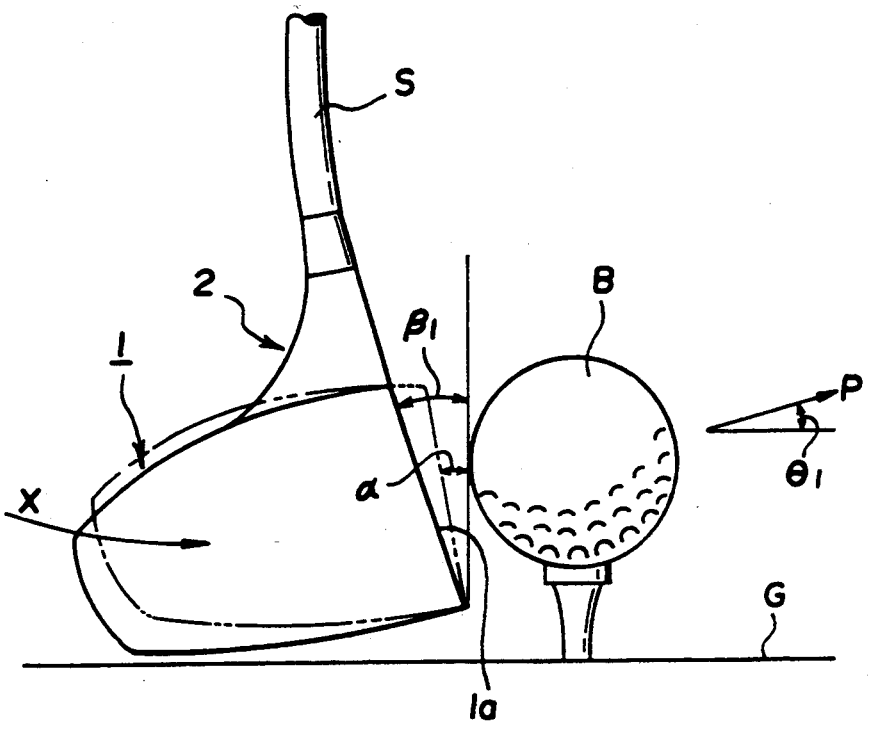
FIG. 9 PRIOR ART
FIG. 9 is a side view of a conventional golf club head at shooting a ball.

Dynamic behaviour of such a golf club head with biased rigidity distribution is shown in FIG. 7. For the purpose of comparison, dynamic behaviour of a conventional golf club head is shown in FIG. 9. In the case off the present invention repulsion generated by flexing of the shaft S and repulsion generated by flexing of the hosel 2 concur to increase the speed of the club head during swing motion, thereby assuring much intensive impact on a ball at shooting. In contrast to this, the speed of the club head in FIG. 9 during swing motion is dependent upon repulsion generated by flexing of the shaft only and, as a result, pact on a ball is less intensive.

Assuming that the two golf club heads are common in nominal loft angle $\alpha$, the effective loft angle ($\beta_2$) in the present invention (FIG. 7) is larger than the effective loft above-described in the conventional art (FIG. 9) thanks to the above-described double flexing system special to the present invention. The resultant launch angle ($\theta_2$) in the present invention (FIG. 7) is larger than the launch angle ($\theta_1$) in the prior art (FIG. 9).

Figure 8:
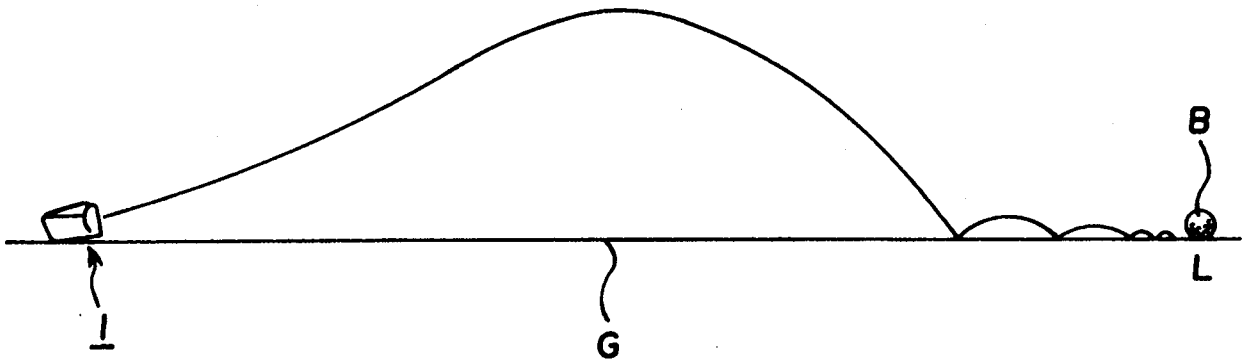
FIG. 8 shows one typical example of the flying course of a ball shot by a golf club head in accordance with the present invention.

When shot by the golf club head in accordance with the present invention, a ball traces a course shown in FIG. 8. The ball B rolls appreciably even after fall on the ground G and an increased flying distance L is resulted.

Figure 10:
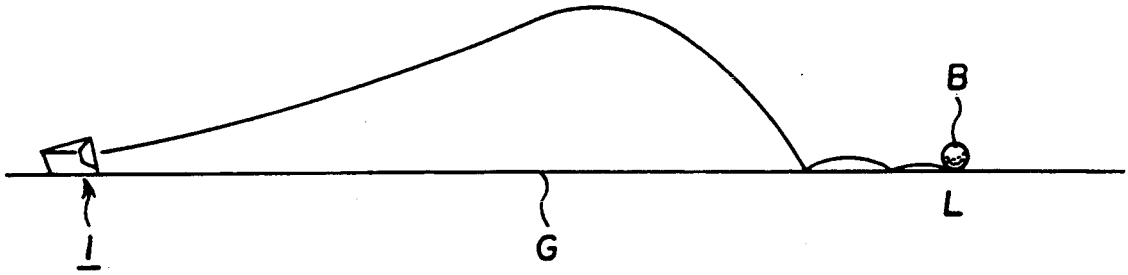
FIG. 10 PRIOR ART
FIG. 10 shows one typical example of the flying course of a ball shot by a conventional golf club head.

For comparison, one example of the course traced by a ball after shot by a conventional golf club head is shown in FIG. 10. The ball B flies short and rolls little after fall on the ground G.

Figure 11:
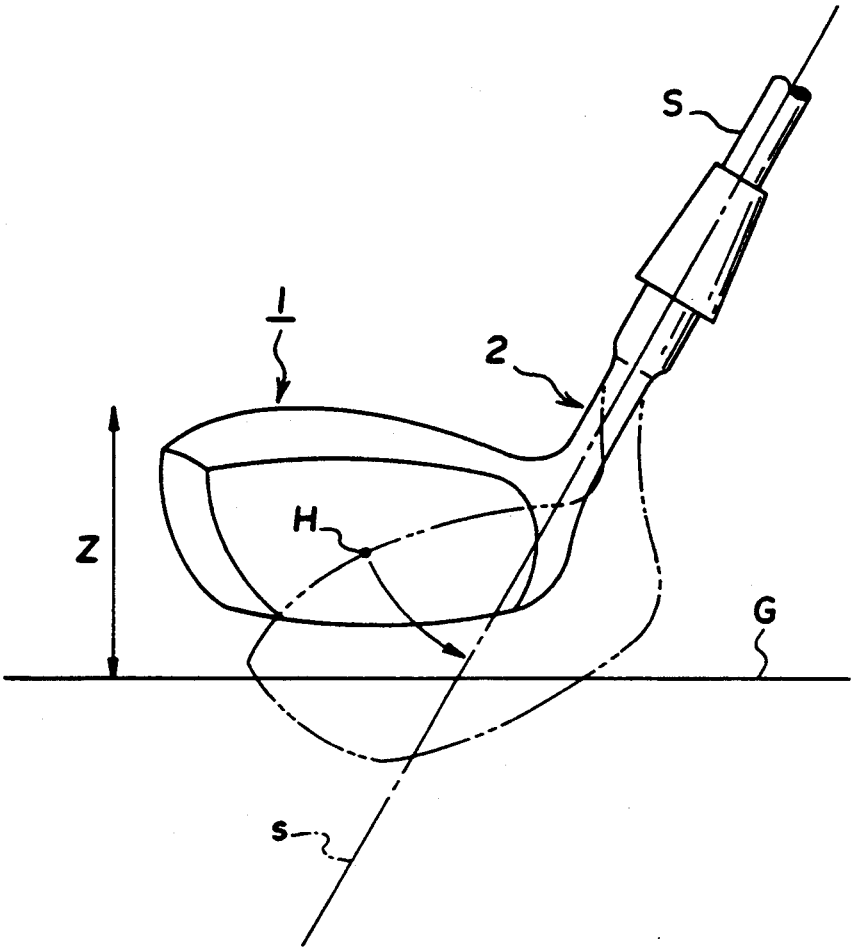
FIG. 11 is a side view for explaining the lack of toe-down deformation which results with a golf club in accordance with the present invention compared to that which results with a conventional golf club head.

Substantial absence of the notorious toe-down deformation in the case of the present invention is seen in FIG. 11. That is, the golf club head in accordance with the present invention assumes a position illustrated with solid lines at the moment of impact. In contrast to this, a conventional golf club head assumes a position illustrated with chain lines at the moment of impact. Apparent presence of tow-down deformation is noted.

We claim:

1. A wood-type golf club head comprising a wood-type main body and a hosel both made of metal or fiber reinforced plastics, the main body having a toe and a heel defining a toe-to-heel direction of said main body and having a ball-shooting direction substantially perpendicular to said toe-to-heel direction, wherein the flexural rigidity of said hosel is larger in said toe-to-heel direction than in said ball-shooting direction.

2. A golf club head as claimed in claim 1 in which said hosel is larger in thickness in said toe-to-heel direction than in said ball-shooting direction.

3. A golf club head as claimed in claim 1 in which said hosel is provided with a through window extending in said ball-shooting direction.

4. A golf club head as claimed in claim 2 in which said hosel is provided with a through window extending in said ball-shooting direction.

* * * * *